United States Patent [19]

Scott

[11] Patent Number: 4,805,244

[45] Date of Patent: Feb. 21, 1989

[54] HEAT SHIELD INSERT

[76] Inventor: Walter B. Scott, 1809 E. 7th St., Superior, Wis. 54880

[21] Appl. No.: 147,938

[22] Filed: Jan. 25, 1988

[51] Int. Cl.[4] ..... A41D 27/02

[52] U.S. Cl. ..... 2/272; 2/227; 2/79; 2/69; 2/81

[58] Field of Search ..... 2/272, 227, 69.5, 69, 2/97, 164, 81, 79, DIG. 3

[56] References Cited

U.S. PATENT DOCUMENTS

| | | | |
|---|---|---|---|
| 1,468,072 | 9/1923 | Ogle | 2/DIG. 3 |
| 1,711,611 | 5/1929 | Mock | 2/227 |
| 2,437,223 | 3/1948 | Dutrow . | |
| 2,637,032 | 5/1953 | Pinsuti . | |
| 3,098,560 | 7/1963 | Skees . | |
| 3,577,305 | 5/1971 | Hines et al. . | |
| 3,636,566 | 1/1972 | Sutherland | 2/69.5 |
| 3,739,399 | 6/1973 | Sheahon | 2/69.5 |
| 4,083,064 | 4/1978 | Schneider | 2/69.5 |
| 4,136,222 | 1/1979 | Jonnes . | |
| 4,282,608 | 8/1981 | Amberg | 2/227 |
| 4,302,847 | 12/1981 | Miles | 2/227 |
| 4,450,193 | 5/1984 | Staebler . | |
| 4,561,121 | 12/1985 | Ehring et al. | 2/227 X |
| 4,658,452 | 4/1987 | Brockhaus . | |
| 4,715,068 | 12/1987 | Jacobson | 2/272 |
| 4,739,522 | 4/1988 | Lassiter et al. | 2/272 X |

*Primary Examiner*—H. Hampton Hunter

*Attorney, Agent, or Firm*—Peterson, Wicks, Nemer & Kamrath

[57] ABSTRACT

A heat shield insert to be worn between inner clothing and outer garments of a person is disclosed including a flexible insulator removeably received in a flexible fabric covering. The insulator in its preferred form includes first and second reflective layers sandwiching sealed, multiple air cell material. The reflective layers reflect body heat back and cold away from the person. The air encapsulated in the air cells acts as insulation in reducing heat transfer and provides a resilient, cushion type support. The heat shield insert has a shape corresponding to the torso and upper leg portions of the person and includes a rectangular portion for substantially covering the torso and first and second leg portions extending from and integral with the rectangular portion for covering the legs to adjacent the knees. The lower edge of the rectangular portion is supported on the crotch of the outer garment. The first and second leg portions extend in the pants leg and the rectangular portion extends in the outer garments for orientating the heat shield insert in the outer garments keeping the heat shield insert from tipping to one side on the crotch of the outer garment. The heat shield insert is flat, thin and flexible allowing the heat shield insert to conform to and bend with the body of the person without restricting movement and without detracting from the aesthetics of the outer garments.

19 Claims, 1 Drawing Sheet

HEAT SHIELD INSERT

BACKGROUND

The present invention relates to cushions and insulators to be used by persons and specifically to heat shield inserts to be worn between the inner clothing and outer garments of a person.

Various types of devices have been developed to maintain a person's comfort when sitting or laying on a hard surface and to help protect the person from cold temperatures and conditions. Such devices have taken the form of cushions, shields, and the like which may be worn and the form of mats or pads which can be carried by the person. However, such devices have suffered from several disadvantages and deficiencies including the restriction of movement, poor aesthetics, and general limitations in providing comfort and warmth which restrict and limit their useage and applications.

A need has then arisen for a heat shield insert which is thin, flexible, and comfortable and can be worn between the inner clothing and the outer garments of a person for stopping chills from entering the area of the back, buttocks, and upper legs of the person and for helping keep these areas warm.

SUMMARY

The present invention solves this need and problems in comforting and warmth protecting devices by providing, in its most preferred form, a heat shield insert for insertion between the inner clothing and outer garments of a person. The heat shield insert includes a rectangular portion and first and second leg portions extending from and integral with the rectangular portion. The rectangular portion has a size and shape for covering the torso of the person from the lower buttocks to adjacent the shoulder blades. The first and second leg portions have a size and shape for covering the legs of the person from the lower torso to adjacent the knees of the person. The lower edge of the rectangular portion is supported on the crotch of the outer garment. The first and second leg portions extend in the pants leg and the rectangular portion extends in the outer garments for orientating the heat shield insert in the outer garments keeping the heat shield insert from tipping to one side on the crotch of the outer garment.

In the preferred form, the heat shield insert includes a flexible insulator received within a flexible covering. In its most preferred form, the insulator includes first and second reflective layers sandwiching sealed, multiple air cell material. The reflective layers reflect body heat back to the person and cold away from the person. The air encapsulated in the air cells of the material acts as insulation in reducing heat transfer and provides a resilient, cushion type support for the person.

It is thus an object of the present invention to provide a novel heat shield insert.

It is further an object of the present invention to provide such a novel heat shield insert which is worn between the inner clothing and outer garments of a person.

It is further an object of the present invention to provide such a novel heat shield insert which does not restrict movement.

It is further an object of the present invention to provide such a novel heat shield insert which stops chills from entering the area of the back, buttocks, and upper legs of a person.

It is further an object of the present invention to provide such a novel heat shield insert which reflects and retains body warmth.

It is further an object of the present invention to provide such a novel heat shield insert which is thin.

It is further an object of the present invention to provide such a novel heat shield insert which is flexible.

It is further an object of the present invention to provide such a novel heat shield insert which is comfortable.

It is further an object of the present invention to provide such a novel heat shield insert which does not aesthetically detract from the appearance of the person.

It is further an object of the present invention to provide such a novel heat shield insert which provides a cushion-type support.

It is further an object of the present invention to provide such a novel heat shield insert which offers floatation assistance.

It is further an object of the present invention to provide such a novel heat shield insert which is moisture proof.

It is further an object of the present invention to provide such a novel heat shield insert which reflects cold away from the person.

It is further an object of the present invention to provide such a novel heat shield insert which does not require securement to the person's other clothing.

It is further an object of the present invention to provide such a novel heat shield insert which is not prone to being pulled up or down by the movement of the wearer.

It is further an object of the present invention to provide such a novel heat shield insert which protects the area of the back, buttocks, and upper legs of a person from dampness.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
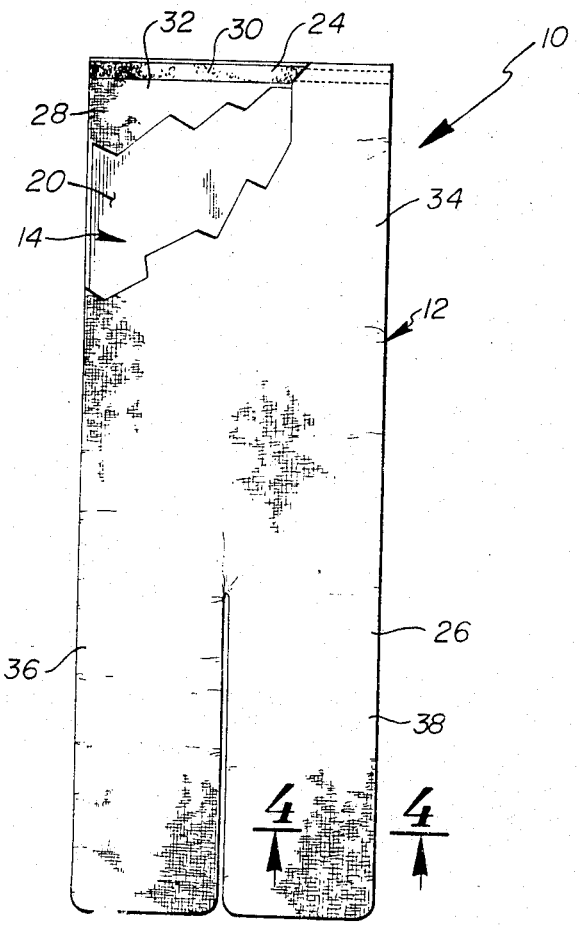
FIG. 1 shows a front plan view of a heat shield insert according to the preferred teachings of the present invention, with portions being broken away.
Figure 2:
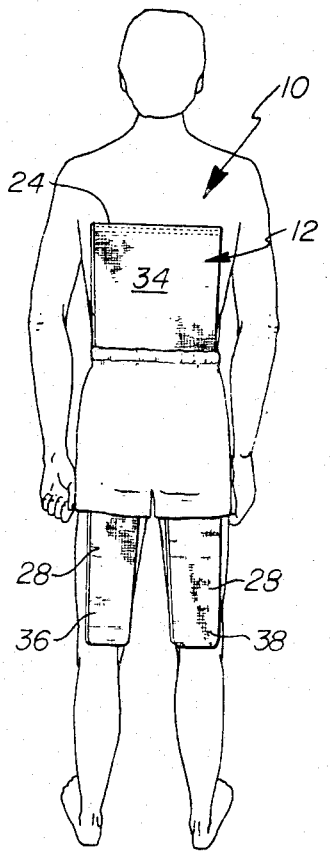
FIGS. 2 and 3 show illustrative views of the heat shield insert of FIG. 1 illustrating the heat shield insert being worn with the wearer being in standing and sitting positions, respectively.
Figure 3:
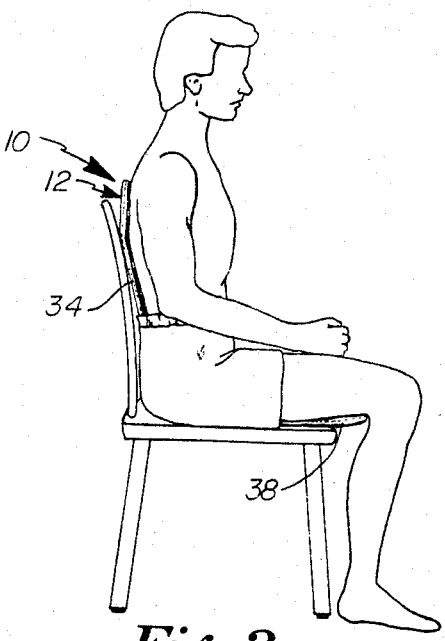
Figure 4:
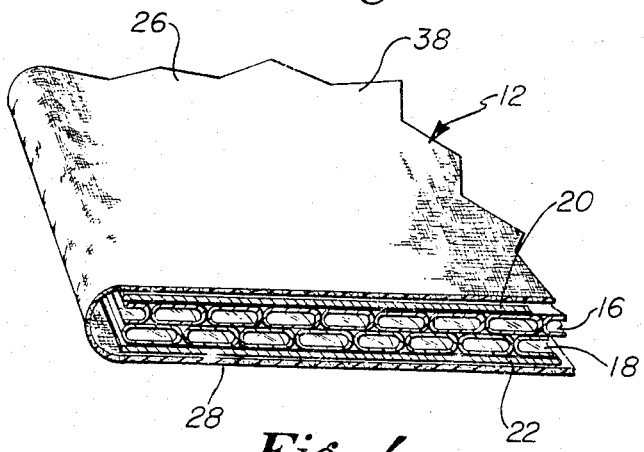
FIG. 4 shows a partial, cross-sectional view of the heat shield insert of FIG. 1 according to section line 4—4 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "inner", "outer", "interior", "internal", and similar terms are used herein, it should be understood that these terms have reference only to the structure shown in the drawings as it would appear to a person viewing the drawings and are utilized only to facilitate describing the invention.

DESCRIPTION

A heat shield insert to be worn by a person between inner clothing and outer garments according to the teachings of the present invention is shown in the drawings and generally designated 10. Insert 10 generally includes a flexible covering 12 and a laminated insulator 14. Insulator 14 is thin, soft, lightweight, flexible, cushiony, heat reflective, and moisture proof. Specifically, in the preferred form of the present invention, insulator 14 is formed of layers 16 and 18 of sealed, multiple air cell material sandwiched between first and second metalized plastic sheet or metallic foil or other reflective member or layers 20 and 22. It can then be appreciated that layers 16 and 18 are formed of plastic material and as such do not absorb or hold water. Similarly, layers 20 and 22 do not absorb or hold water. It can further be appreciated that the air encapsulated in layers 16 and 18 acts as a insulator in reducing heat transfer. Additionally being lighter than water and due to its moisture proof nature, insulator 14 floats in water and offers floatation assistance in insert 10 as will be described further hereinafter. Similarly, layers 16 and 18 provide a resilient, cushion-type support as the encapsuled air within layers 16 and 18 can be compressed to act in the manner of a shock absorber and spring. In the most preferred form, insulator 14 is one-fourth of an inch thick.

Flexible covering 12 is a bag-like component having an open top 24 for receipt of and enclosing insulator 14. Generally, covering 12 includes two halves 26 and 28 having a shape and size corresponding to but slightly larger than insulator 14. Halves 26 and 28 are joined by their side and bottom peripheries such as by stitching. Suitable provisions 30 such as VELCRO TM hook and loop type fasteners may be provided for releasably closing open top 24 to allow removable placement of insulator 14 within interior 32 of covering 12.

In its most preferred form, covering 12 may be formed of flexible material such as fabric which can be stain and wear resistant, washable, and comfortable to the touch of the skin of the wearer.

Insert 10 according to the teachings of the present invention has a shape corresponding to the torso or trunk and upper leg portions of the wearer. Specifically, insulator 14 and halves 26 and 28 generally include a rectangular portion 34 and leg portions 36 and 38. Rectangular prtion 34 extends from the lower buttocks of the torso to adjacent the shoulder blades of the wearer when worn adjacent the back and in the preferred form is 11¾ inches wide by 16 inches long (29.9 cm by 40.6 cm). Leg portions 36 and 38 extend from and are integral with the lower edge of rectangular portion 34 and cover the legs from the lower buttocks of the torso to adjacent the knees of the wearer when adjacent the back and in the preferred form are 5½ inches wide by 12 inches long (14 cm×30.5 cm). Insert 10 has a thickness generally equal to the thickness of insulator 14, as the thickness of halves 26 and 28 is relatively small, and specifically has a thickness in the range of ⅜ inch (0.95 cm). Insert 10 according to the teachings of the present invention is lightweight and specifically weighs in the range of 6 ounces.

Now that the construction of insert 10 according to the teachings of the present invention has been explained, the preferred uses and advantages of insert 10 can be set forth and appreciated. Specifically, due to its thinness, insert 10 may be inserted between the inner clothing and outer garments such as slacks, pants, or coverall and shirt of a person in a manner as shown in the Drawings. Thus, insert 10 may be completely concealed in the outer garments of the wearer. It can then be appreciated that the use of insert 10 in the Drawings is shown utilized with an outer garment of the type of walking shorts to allow illustration of the use and positioning of insert 10 inside of the wearer's outer garments and relative to the wearer's body.

It should then be appreciated that no attachments of any kind are needed as insert 10 is worn internally and is supported by the outer garments of the wearer. Specifically, the bottom edge of rectangular portion 34 between leg portions 36 and 38 abut with the crotch of the slacks, pants, coverall or the like of the wearer. Further, leg portions 36 and 38 of insert 10 extending down the pants leg of the outer garment to adjacent the knee of the wearer and rectangular portion 34 extending into the buttock, waist, and shirt portions of the wearer's outer garments act as pilots or guides for orientating insert 10 within the outer garments to keep insert 10 from tipping to one side or the other of the crotch of the wearer's outer garment. It can be further appreciated that the restriction of a waistband, belt or the like of the wearer's outer garments, if any, also assists in holding insert 10 in place inside of the outer garments of the wearer. It can then be appreciated that snaps, loops, and other attachment devices detract from the comfort and appearance of prior internally worn cushions as adding additional and uneven thickness.

Insert 10 according to the teachings of the present invention is advantageous in its comfort and lack of restriction to the wearer's movement. Specifically, insert 10 is lightweight, thin, and flexible such that it can be inserted easily and without bulkiness in the not extend around or between the wearer's arms or legs, restriction of movement is minimized if non-existant Further, since insert 10 is not attached to the wearer's other clothing, insert 10 according to the teachings of the present invention is not prone to being pulled up or down by the movement of the wearer such as by bending over or sitting. Similarly, since insert 10 is worn internally of outer garments, insert 10 according to the teachings of the present invention is not prone to catch on objects and is hidden from view.

According to the teachings of the present invention, layer 20 reflects the wearer's body heat back to the wearer and similarly, layer 22 reflects away the cold such as of a cold chair, seat, floor or the like. This feature maximizes the use of the wearer's body heat in keeping the wearer warm. Further, with layers 16 and 18 of insulator 14, this feature also reduces the loss of the wearer's body heat such that the wearer's body heat is retained.

Covering 12 according to the teachings of the present invention adds comfort to the wearer as it covers insulator 14 and specifically layer 20 thereof such that layer 20 does not directly engage the wearer's skin as layers 20 and 22 of insulator 14 may be abrasive to the wearer's skin and inner and outer garments. Further, covering 12 absorbs any perspiration of the wearer and keeps insulator 14 from sticking to the person's skin from such perspiration to provide added comfort. Additionally, due to the releasably closable nature of open top 24, covering 12 may be washed after insulator 14 is removed from interior 32 thereof.

It can further be appreciated that insulator 14 does not absorb moisture such that insert 10 according to the teachings of the present invention provides extra floatation in the event that the wearer should fall or otherwise find himself in water. It can then be appreciated that insert 10 according to the teachings of the present invention is especially advantageous in marine settings and outdoor sports occurring on or adjacent to ice or water such as fishing, ice boat sailing, or skating as insert 10 adds floatation assistance in addition to acting as a heat shield.

Insert 10 according to the teachings of the present invention can be worn at work or recreation to protect the back, buttocks, and upper legs from cold objects, winds and dampness and to thus keep these parts of the body warm, dry, and comfortble. Thus, cold chills are stopped from entering the person's back, buttocks, and upper legs to avoid painful, sore, aching muscles induced by cold chills. This is especially important when the person is lying on cold floors or ground such as automotive mechanics or is sitting on cold chairs or seats such as game spectators, heavy equipment operators, and automobile and truck drivers. Similarly, insert 10 according to the teachings of the present invention can be worn at work or recreation to reflect and retain the body warmth of the person to thus help keep the vital areas around the spine and kidneys warm. Additionally, insert 10 according to the teachings of the present invention cushions the person in a sitting or laying position such as heavy equipment operators bouncing on hard seats, game spectators, snowmobilers, and the like. Further, due to its lightweight, thin, and flexible nature, insert 10 according to the teachings of the present invention may be comfortably and aesthetically worn without restricting body movement such as by mountain climbers, hunters, military personnel, and the like. It can then be appreciated that cushion 10 according to the teachings of the present invention provides a synergistic combination for solving the problems associated with cold, damp, and/or windy conditions and/or associated with sitting or laying on relatively hard surfaces.

Now that the basic teachings of the present invention have been explained, many extensions and variations will be obyious to one having ordinary skill in the art. For example, although several anticipated uses for insert 10 according to the teachings of the present invention have been disclosed, other uses of insert 10 will be known by persons skilled in the art after the teachings of the present invention become known such as by refrigeration mechanics who may have to sit on ice or frozen objects, by backpackers, campers, and the like.

Similarly, although insert 10 has been described as being worn adjacent the back of the person, it should be appreciated that insert 10 may be worn in other positions according to the teachings of the present invention to stop chills from entering the body of the person and to reflect and retain body warmth. For example, motorcycle, snowmobile, and all-terrain vehicle riders can wear insert 10 adjacent the front of the body to reduce wind chill resulting from the forward movement of the motorcycle, snowmobile, all-terrain vehicle, or the like. Due to the flexibility, thinness, and comfort of insert 10 according to the teachings of the present invention, insert 10 may be worn in the front without restricting body movement while obtaining its advantages as previously set forth.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are inended to be embraced therein.

What is claimed is:

1. Heat shield insert for a person wearing inner clothing and outer garments, with the outer garments including pants legs defining a crotch comprising, in combination: at least a first layer of sealed, multiple air cell material, with the air encapsulated in the air cells of the material acting as insulation in reducing heat transfer and providing a resilient, cushion type support; first and second reflective layers sandwiching the layer of sealed, multiple air cell material, with the first reflective layer intermediate the air cell material and the inner clothing of the person for reflecting the body heat of the person back to the person, with the second reflective layer reflecting cold away from the layer of sealed, multiple air cell material and the person, with the layer of air cell material and the first and second reflective layers forming an insulator; a flexible covering for receiving the insulator, with the insulator and the flexible covering being insertable between the inner clothing and outer garments of the person for reducing the loss of the person's body heat, with the insulator and the flexible covering being flat and having a thinness and flexibility allowing the insulator and the flexible covering to conform to and bend with the body of the person, with the insulator and the flexible covering including a rectangular portion having a lower edge and a size and shape for covering the torso of the person from adjacent the legs to adjacent the shoulder blades, and first and second leg portions extending from and integral with the lower edge of the rectangular portion and having a size and shape for covering the legs of the person from the lower torso to adjacent the knees of the person, with the lower edge of the rectangular portion being supported on the crotch of the outer garment and with the first and second leg portions extending in the pants leg and the rectangular portion extending in the outer garments orientating the insulator and the flexible covering in the outer garments keeping the insulator and the flexible covering from tipping to one side on the crotch of the outer garment.

2. The heat shield insert of claim 1 wherein the flexible covering comprises, in combination: a first half having a side periphery, a bottom periphery, and a top; and a second half having a side periphery, a bottom periphery, and a top, with the first and second halves being joined by their side and bottom peripheries to form a bag-like component defining an interior, with the insulator located within the interior of the bag-like component.

3. The heat shield insert of claim 2 wherein the flexible covering further comprises, in combination: means for removably securing the top of the first half to the top of the second half allowing the removeable placement of the insulator within the interior of the bag-like component.

4. The heat shield insert of claim 3 wherein the first and second reflective members and the layer of sealed, multiple air cell material of the insulator are formed of non-moisture absorbing and retaining material.

5. The heat shield insert of claim 3 wherein the flexible covering is formed of washable, wear resistant fabric which feels comfortable to the skin of the person 6. The heat shield insert of claim 1 wherein the flexible covering is formed of washable, wear resistant fabric which feels comfortable to the skin of the person.

7. The heat shield insert of claim 1 wherein the first and second reflective members and the layer of sealed, multiple air cell material of the insulator are formed of non-moisture absorbing and retaining material.

8. Heat shield insert for a person wearing inner clothing and outer garments, with the outer garments including pants legs defining a crotch, comprising, in combination: means for insertion between the inner clothing and outer garments of the person for reducing the loss of the person's body heat, with the reducing means being flat and having a thinness and flexibility allowing the reducing means to conform to and bend with the body of the person, with the reducing means including a rectangular portion having a lower edge and a size and shape for covering the torso of the person from adjacent the legs to adjacent the shoulder blades, and first and second leg portions extending from and integral with the lower edge of the rectangular portion and having a size and shape for covering the legs of the person from the lower torso to adjacent the knees of the person, with the lower edge of the rectangular portion being supported on the crotch of the outer garment and with the first and second leg portions extending in the pants leg and the rectangular portion extending in the outer garments orientating the reducing means in the outer garments keeping the reducing means from tipping to one side on the crotch of the outer garment.

9. The heat shield insert of claim 8 wherein the reducing means comprises, in combination: a flexible insulator received within a flexible covering.

10. The heat shield insert of claim 9 wherein the insulator comprises, in combination: at least a first layer of sealed, multiple air cell material, with the air encapsulated in the air cells of the material acting as insulation in reducing heat transfer and providing a resilient, cushion type support; and at least a first reflective layer intermediate the air cell material and the inner clothing of the person for reflecting the body heat of the person back to the person.

11. The heat shield insert of claim 10 wherein the insulator further comprises, in combination: a second reflective layer, with the first and second reflective layers sandwiching the layer of sealed, multiple air cell material, with the second reflective layer reflecting cold away from the layer of sealed, multiple air cell material and the person.

12. The heat shield insert of claim 11 wherein the covering comprises, in combination: a first half having a side periphery, a bottom periphery, and a top; and a second half having a side periphery, a bottom periphery, and a top, with the first and second halves being joined by their side and bottom peripheries to form a bag-like component defining an interior, with the insulator located within the interior of the bag-like component.

13. The heat shield insert of claim 12 wherein the covering further comprises, in combination: means for removably securing the top of the first half to the top of the second half allowing the removeable placement of the insulator within the interior of the bag-like component.

14. The heat shield insert of claim 12 wherein the flexible covering is formed of washable, wear resistant fabric which feels comfortable to the skin of the person.

15. The heat shield insert of claim 13 wherein the insulator is moisture proof and will not absorb moisture.

16. The heat shield insert of claim 9 wherein the insulator is moisture proof and will not absorb moisture.

17. The heat shield insert of claim 9 wherein the flexible covering is formed of washable, wear resistant fabric which feels comfortable to the skin of the person.

18. The heat shield insert of claim 9 wherein the covering comprises, in combination: a first half having a side periphery, a bottom periphery, and a top; and a second half having a side periphery, a bottom periphery, and a top, with the first and second halves being joined by their side and bottom peripheries to form a bag-like component defining an interior, with the insulator located within the interior of the bag-like component.

19. The heat shield insert of claim 18 wherein the covering further comprises, in combination: means for removably securing the top of the first half to the top of the second half allowing the removeable placement of the insulator within the interior of the bag-like component.

* * * * *